US008474523B2

(12) United States Patent
Rayssiguier et al.

(10) Patent No.: US 8,474,523 B2
(45) Date of Patent: Jul. 2, 2013

(54) METHOD AND APPARATUS FOR TREATMENT OF A PERFORATED CASING

(71) Applicant: Schlumberger Technology Corporation, Sugar Land, TX (US)

(72) Inventors: Christophe M Rayssiguier, Melun (FR); Simon Gareth James, Le Plessis-Robinson (FR); Philippe Gambier, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 13/652,404

(22) Filed: Oct. 15, 2012

(65) Prior Publication Data

US 2013/0075095 A1 Mar. 28, 2013

Related U.S. Application Data

(62) Division of application No. 12/295,452, filed on Aug. 25, 2009, now Pat. No. 8,312,921.

(51) Int. Cl.
*E21B 33/12* (2006.01)

(52) U.S. Cl.
USPC ..... 166/179; 166/202; 166/387

(58) Field of Classification Search
USPC ..... 166/179, 202, 387
See application file for complete search history.

(56) References Cited

U.S. PATENT DOCUMENTS

| | | | |
|---|---|---|---|
| 2,922,478 | A | 1/1960 | Maly |
| 3,130,787 | A | 4/1964 | Mason |
| 3,270,814 | A | 9/1966 | Richardson et al. |
| 3,366,391 | A | 1/1968 | Gore |
| 3,460,625 | A | 8/1969 | Hart et al. |
| 3,627,046 | A | 12/1971 | Miller et al. |
| 4,791,992 | A | 12/1988 | Greenlee et al. |
| 5,297,633 | A | 3/1994 | Snider et al. |
| 5,337,823 | A | 8/1994 | Nobileau |
| 5,343,956 | A | 9/1994 | Coronado |
| 5,613,557 | A | 3/1997 | Blount et al. |
| 5,697,441 | A | 12/1997 | Vercaemer et al. |
| 6,253,850 | B1 | 7/2001 | Nazzai et al. |
| 7,789,148 | B2 | 9/2010 | Rayssiguier et al. |
| 2002/0011341 | A1 | 1/2002 | Ingram et al. |
| 2009/0260817 | A1 | 10/2009 | Gambier et al. |

FOREIGN PATENT DOCUMENTS

| | | |
|---|---|---|
| EP | 1426551 | 6/2004 |
| EP | 1757770 | 2/2007 |
| WO | 03/042494 | 5/2003 |
| WO | 2004/097167 | 11/2004 |

*Primary Examiner* — Kenneth L Thompson
*Assistant Examiner* — Ronald Runyan
(74) *Attorney, Agent, or Firm* — Michael Dae

(57) ABSTRACT

A method of and apparatus for treating a zone in a well is disclosed. A tube that is permeable to a material is inserted into a wellbore, creating an annulus inside the wellbore. Two zones—the annular region and the formation surrounding the wellbore—may be treated. The method comprises the following steps. (1) A setting section surrounded by a sleeve is placed inside the tube near the zone to treat, the sleeve being expandable and impermeable to the material. (2) The sleeve is inflated inside the tube near the zone to treat, ensuring that a first zone of the tube is impermeable to the material, but leaving a second zone permeable to the material. (3) A treatment fluid is pumped to the zone to treat, the treatment fluid passing into the annulus via the second zone. (4) The zone to treat is treated with the treatment fluid.

20 Claims, 13 Drawing Sheets

METHOD AND APPARATUS FOR TREATMENT OF A PERFORATED CASING

CROSS-REFERENCED APPLICATION

This application is a divisional application of the U.S. application Ser. No. 12/295,452, which was derived from PCT Application PCT/EP2007/001556 filed on Feb. 16, 2007, claiming priority from the European Application EP 06290518.7 filed on Mar. 31, 2006, all being incorporated herein by reference in their entirety.

FIELD OF THE INVENTION

The present invention broadly relates to well cementing. More particularly the invention relates to servicing apparatus for completing downhole wells from a subterranean reservoir, such as for instance an oil and gas reservoir or a water reservoir.

DESCRIPTION OF THE PRIOR ART

After a well has been drilled, the conventional practice in the oil industry consists in lining the well with a metal casing. The casing is lowered down the hole and cement is pumped inside the casing and returns through the annulus where it is allowed to set. The lining serves a dual purpose: preventing the borehole walls from collapsing and isolating the various geological strata and thus, avoiding exchange of fluids between them. Furthermore, it can be useful, for different reasons, to fill the well with a permeable screen (meaning not impermeable like a metal casing) such as a perforated tubular, a tubular with other openings, a slotted liner or an expandable screen. Use of such permeable screens allows for example oil to pass the borehole walls from production zones into the centre of the hole whilst retaining debris. But sometimes, for various reasons, the permeable screen and annular space between the screen and wellbore wall have finally to be closed and made "impermeable". For example, a production zone may be producing water or gas and needs to be shut off for more effective production of the oil being recovered. Also, a zone may be producing sand or collapsing and creating too much debris and needs to be isolated to maintain an efficient operation.

Whenever a permeable screen is present downhole, there is no simple way to cement the annulus. Effectively, conventional technique where cement is pumped inside the permeable screen to be returned through the annulus will not work, because the cement will pass through the first openings of the permeable screen and no cement will be pumped to the other extremity. Further cement would fill the inside of the permeable screen and extra drilling, which is costly and time consuming, will be required after the cement is set. This conventional technique does not apply to other types of fluids and there is no simple way to make a treatment to a zone of the borehole behind a permeable screen.

Some prior arts have intended to solve those limitations but only partially or unsuccessfully. U.S. Pat. No. 5,613,557 discloses an apparatus and related method to seal perforation of a casing to substantially prevent fluid communication between the adjoining earth formation and the inside of the casing. In this example, there is no cement behind the perforations of the casing. A sleeve like member is deployed in the casing by a high energy explosive charge to engage with the inner wall of the casing. The sleeve like member plastically deforms and because of its adhesive and thermosetting properties, ensures a forcible engagement with the casing and minimizes fluid leakage around or through the sleeve member. The sleeve is secured permanently and remains in place. No further communication with the annulus is possible.

Further U.S. Pat. No. 6,253,850 also discloses a method to seal or isolate a selective zone containing this time a slotted liner. In this example, there is no cement behind the slotted liner. An additional expandable liner is deployed within a slotted liner and expands until sealing contact with the original slotted liner. The expandable liner is formed with use of a mechanical device such as a mandrel or an inflatable member, or by a hydropneumatic force, including explosive charge. The expandable liner is also secured permanently and remains in place. No further communication with the annulus is possible.

Hence, it remains the need for a method of treatment of the earth formation behind a perforated casing, a slotted liner or an expandable and permeable screen, which does not change the structure of the perforated casing, the slotted liner or the expandable and permeable screen. More precisely, the aim of the invention is to fill the annular space behind the perforated casing not just making the perforated casing permanently impermeable.

SUMMARY OF THE INVENTION

According to one aspect of the invention, the invention provides a method of treatment of a near zone of a well, or a method of treatment of a far zone of a well, or a method of treatment of a near zone and a far zone of a well, wherein inside the well, a wellbore in a formation is filled with a tube which is permeable to a material, the tube forming an annulus with the wellbore, and the zone being localized beyond the tube in the annulus and/or in the formation, and wherein the method comprises the steps: (i) placing inside the tube a setting section surrounded by a sleeve near the zone to treat, the sleeve being expandable and impermeable to the material; (ii) inflating the sleeve so that the sleeve is in contact with the tube near the zone to treat, ensuring for a first zone of the tube impermeability to the material, but leaving a second zone permeable to the material; (iii) pumping a treatment fluid to the zone to treat, the treatment fluid passing into the annulus via the second zone still permeable to the material; and (iv) treating the zone to treat with the treatment fluid.

According to a second aspect of the invention, the invention provides a method to consolidate a near zone of a well, or a method to consolidate a far zone of a well, or a method to consolidate a near zone and a far zone of a well, wherein inside the well, a wellbore in a formation is filled with a tube which is permeable to a material, the tube forming an annulus with the wellbore, and the zone being localized beyond the tube in the annulus and/or in the formation, and wherein the method comprises the steps: (i) placing inside the tube a setting section surrounded by a sleeve near the zone to consolidate, the sleeve being expandable and impermeable to the material; (ii) inflating the sleeve so that the sleeve is in contact with the tube near the zone to consolidate, ensuring for a first zone of the tube impermeability to the material, but leaving a second zone permeable to the material; (iii) pumping a treatment fluid to the zone to consolidate, the treatment fluid passing into the annulus via the second zone still permeable to the material; and (iv) consolidating the zone to treat with the treatment fluid. Preferably, the method to consolidate comprises the steps: (i) placing inside the tube a setting section surrounded by a sleeve near the zone to consolidate, the sleeve being expandable and impermeable to the material; (ii) inflating the sleeve so that the sleeve is in contact with the tube near the zone to consolidate, ensuring for a first zone of the tube impermeability to the material, but leaving a second zone permeable to the material; (iii) pumping a settable fluid to the zone to consolidate, the settable fluid passing into the annulus via the second zone still permeable to the material; (iv) allowing the settable fluid to set; (v) deflating the sleeve so that the sleeve is no more in contact with the tube near the zone to consolidate; and (vi) removing the setting section with the sleeve from the zone to consolidate by putting it out.

According to a third aspect of the invention, the invention provides a method to isolate a near zone of a well, or a method to isolate a far zone of a well, or a method to isolate a near zone and a far zone of a well, wherein inside the well, a wellbore in a formation is filled with a tube which is permeable to a material, the tube forming an annulus with the wellbore, and the zone being localized beyond the tube in the annulus and/or in the formation, and wherein the method comprises the steps: (i) placing inside the tube a setting section surrounded by a sleeve near the zone to isolate, the sleeve being expandable and impermeable to the material; (ii) inflating the sleeve so that the sleeve is in contact with the tube near the zone to isolate, ensuring for a first zone of the tube impermeability to the material, but leaving a second zone permeable to the material; (iii) pumping a treatment fluid to the zone to isolate, the treatment fluid passing into the annulus via the second zone still permeable to the material; and (iv) isolating the zone to treat with the treatment fluid. Preferably, the method to isolate comprises the steps: (i) placing inside the tube a setting section surrounded by a sleeve near the zone to isolate, the sleeve being expandable and impermeable to the material; (ii) inflating the sleeve so that the sleeve is in contact with the tube near the zone to isolate, ensuring for a first zone of the tube impermeability to the material, but leaving a second zone permeable to the material; (iii) pumping a settable fluid to the zone to isolate, the settable fluid passing into the annulus via the second zone still permeable to the material; (iv) allowing the settable fluid to set; (v) deflating the sleeve so that the sleeve is no more in contact with the tube near the zone to isolate; and (vi) removing the setting section with the sleeve from the zone to isolate by putting it out.

There are possible uses of the methods, in one case, the second zone is a void making communication with the zones: this configuration can appear when the zones is at the bottom of the well and when the tube ends leaving direct communication between the inside of the well and the earth formation; this configuration can also appear in the well when an unconsolidated zone is in direct communication with the earth formation. In a second case, the second zone is an element permeable to the material, for example the permeable element can be the tube: this configuration can appear when a part the tube is made impermeable and another part of the same tube is used to ensure flow of the treatment fluid from the inside of the well to the annulus and to the zones.

Preferably, the method according to the invention further comprises the step of deflating the sleeve so that the sleeve is no more in contact with the tube near the zones; also preferably, the invention further comprises the step of removing the setting section surrounded by the sleeve from the zones. The inside of the tube is left unchanged after the zones have been treated or consolidated or isolated.

In a first embodiment, the step of placing the setting section surrounded by a sleeve is done by placing first the sleeve inside the tube and after the setting section inside the sleeve. The sleeve can be lowered in the well first, positioned near the zones; and after the setting section can be positioned inside the sleeve so the step of inflating can begin. In a second embodiment, the step of placing the setting section surrounded by a sleeve is done by placing into the tube the setting section already surrounded by the sleeve. The sleeve can be positioned on the setting section before to be positioned near the zones. Preferably, in a configuration where the well has a longitudinal axis (A), the step of placing the setting section surrounded by a sleeve further comprises the step of deploying the sleeve longitudinally to the axis (A). The sleeve is arranged like a fan on the setting section and can be deployed on its length to cover the part of the tube or all the tube to be impermeabilized.

In one example of realization, the setting section has an upper part and a lower part, the setting section being connected to a delivery section going on surface at the upper part, and being in communication with the inside of the well at the lower part through a delivery opening, and the step of pumping a treatment fluid to the zones is done by: (i) delivering the treatment fluid inside of the well through the delivery section, through the setting section and through the delivery opening; (ii) filling the inside of the well located downhole from the lower part with the treatment fluid, until the treatment fluid passes into the annulus via the second zone still permeable to the material; and (iii) rising said treatment fluid into the zones.

In a second example of realization, the setting section has an upper part and a lower part, the setting section being connected to a delivery section going on surface at the upper part, and being in communication with the inside of the well at the lower part through a delivery opening, and wherein the step of pumping a treatment fluid to the zones is done by: (i) delivering a first fluid inside of the well through the delivery section, through the setting section and through the delivery opening; (ii) filling the inside of the well located downhole from the lower part with the first fluid, until the first fluid realized a plug inside of the well; (iii) delivering the treatment fluid inside of the well through the delivery section, through the setting section and through the delivery opening; (iv) filling the inside of the well located downhole from the lower part and uphole from the plug, with the treatment fluid, until the treatment fluid passes into the annulus via the second zone still permeable to the material; and (v) rising the treatment fluid into the zones. The first fluid can be a viscous bentonite fluid, a delayed-gel fluid, or a reactive fluids system.

In a third example of realization, the setting section has an upper part and a lower part, the setting section being connected to a delivery section going on surface at the upper part, and being in communication with the inside of the well at the lower part through a delivery opening, and wherein the step of pumping a treatment fluid to the zones is done by: (i) deploying a plug inside of the well; (ii) plugging the inside of the well located downhole from the lower part with the plug; (iii) delivering the treatment fluid inside of the well through the delivery section, through the setting section and through the delivery opening; (iv) filling the inside of the well located downhole from the lower part and uphole from the plug, with the treatment fluid, until the treatment fluid passes into the annulus via the second zone still permeable to the material; and rising the treatment fluid into the zones. The plug is a device with an expandable sleeve which acts as a plug when the expandable sleeve is inflated. The plug can be deployed inside the well with the apparatus of the invention or with another apparatus.

In various possible examples of realization, the methods of the invention work when the tube is taken in the list constituted by: perforated casing, perforated tubing, perforated pipe, perforated conduit, slotted liner, screen, expandable casing, expandable screen, tube comprising opening, tube comprising permeable component, and permeable component; when the material is taken in the list constituted by: oil, water, cement, sand, gravel, gas; when the setting section is taken in the list constituted by: coiled tubing, drill pipe; when the delivery section is taken in the list constituted by: coiled tubing, drill pipe; when the sleeve is made of rubber; when the treatment fluid is a settable fluid or a non settable fluid; when the settable fluid is taken in the list constituted by: conventional cement, remedial cement, permeable cement, phosphate cement, special cement, inorganic and organic sealants, remedial resin, permeable resin, geopolymer materials; when the non settable fluid is taken in the list constituted by: acid, washer.

In the case where the treatment fluid is a settable fluid, the method further comprises the steps of: (v) allowing the treatment fluid to set; (vi) deflating the sleeve so that the sleeve is no more in contact with the tube near the zones; and (vii) removing the setting section with the sleeve from the zones by putting it out. In a preferred embodiment, the method further comprises the step of: (viii) drilling the well with a drilling tool.

According to a fourth aspect of the invention, the invention provides an apparatus for treatment of a near and/or a far zone of a well or to consolidate a near and/or a far zone or to isolate a near and/or a far zone, the zone being localized beyond a tube placed inside the well and forming an annulus with a wellbore, the tube being permeable to a material, and the apparatus comprising: (i) a setting section surrounded by a sleeve, the sleeve being expandable and impermeable to the material; (ii) an inflating means for inflating the sleeve, the inflating means ensuring that the sleeve is in contact with a first zone of the tube so that the first zone of the tube becomes impermeable to the material; and (iii) a delivery opening for delivering a treatment fluid to the zone to treat, the delivery opening ensuring that the treatment fluid passes into the annulus via a second zone still permeable to said material.

There are possible configurations of the delivery opening, in a first configuration they ensure that the treatment fluid passes into the annulus via a void making communication with the zones to treat; in a second configuration, they ensure that the treatment fluid passes into the annulus via an element permeable to the material, preferably the permeable element is a part of the tube.

Preferably, the apparatus comprises: a deflector for forcing delivery of the treatment fluid uphole of the delivery opening and/or directed on the second zone. Preferably also, the apparatus comprises: a deflating means for deflating the sleeve, the deflating means ensuring that the sleeve is no more in contact with the tube.

Preferably, the sleeve is attached to the setting section with connecting means at the upper part and/or with connecting means at the lower part. In one embodiment, the connecting means are connected permanently to the setting section; in a second embodiment the connecting means are removable connecting means; in a third embodiment the connecting means are floating means.

The apparatus preferably comprises a longitudinal axis (A') and the sleeve can be extended longitudinally along the axis (A') on the setting section. Also the sleeve is arranged like a fan on the setting section and can be deployed on its length to cover the part of the tube or all the tube to be impermeabilized. The sleeve has a length (D) along the axis (A') varying between 1 meter and 200 meters, preferably, between 2 meters and 100 meters, and more preferably between 5 meters and 50 meters.

In another configuration, the setting section has an upper part and a lower part and the apparatus further comprises a delivery section going on the surface connected to the upper part.

In various possible examples of realization, the apparatus of the invention works when the tube is taken in the list constituted by: perforated casing, perforated tubing, perforated pipe, perforated conduit, slotted liner, screen, expandable casing, expandable screen, tube comprising opening, tube comprising permeable component, and permeable component; when the material is taken in the list constituted by: oil, water, cement, sand, gravel, gas; when the setting section is taken in the list constituted by: coiled tubing, drill pipe; when the delivery section is taken in the list constituted by: coiled tubing, drill pipe; when the sleeve is made of rubber; when the treatment fluid is a settable fluid or a non settable fluid; when the settable fluid is taken in the list constituted by: conventional cement, remedial cement, permeable cement, phosphate cement, special cement, inorganic and organic sealants, remedial resin, permeable resin, geopolymer materials; when the non settable fluid is taken in the list constituted by: acid, washer.

In examples of realization, the inflating means is a device delivering a gas and/or a liquid inside the sleeve; is a check valve delivering mud into the inside of the sleeve; is a pump delivering mud into the inside of the sleeve.

In other examples of realization, the apparatus further comprises a deflating means for deflating the sleeve, the deflating means ensuring that the sleeve is no more in contact with the tube and wherein the deflating means is a device releasing the gas and/or the liquid from the sleeve.

In one embodiment, the apparatus further comprises an additional section sliding on the setting section and wherein: the inflating means is an opening through the setting section and the additional section, the inflating means having an open and a close position depending on position of the setting section versus the additional section, the position being controlled by translation and/or rotation.

In a second embodiment, the apparatus further comprises a deflating means for deflating the sleeve, the deflating means ensuring that the sleeve is no more in contact with the tube and further comprising an additional section sliding on the setting section and wherein: the deflating means is an opening through the setting section and the additional section, the deflating means having an open and a close position depending on position of the setting section versus the additional section, the position being controlled by translation and/or rotation.

In third embodiment, the apparatus further comprises an additional section sliding on the setting section and wherein: the delivery opening is an opening through the setting section and the additional section, the delivery opening having an open and a close position depending on position of the setting section versus the additional section, the position being controlled by translation and/or rotation.

Preferably, the additional section further comprises a weighting element.

In a fourth embodiment, the setting section has an upper part and a lower part and the apparatus further comprises a delivery section going on surface connected to said upper part and a disconnect mechanism to allow the delivery section to be disconnected from the setting section. Preferably, the disconnect mechanism disconnects the delivery section from the setting section when the treatment of the zone to treat is finished. More preferably, the disconnect mechanism comprises a pin end or box end located on the setting section, and respectively a box end or pin end on the delivery section and a sliding sleeve retaining the pin end and box end in connected position. More preferably, the disconnect mechanism is only actuated by the differential pressure existing between the inside of the setting section and the inside of the well.

BRIEF DESCRIPTION OF THE DRAWINGS

Further embodiments of the present invention can be understood with the appended drawings.

DETAILED DESCRIPTION

Figure 1A:
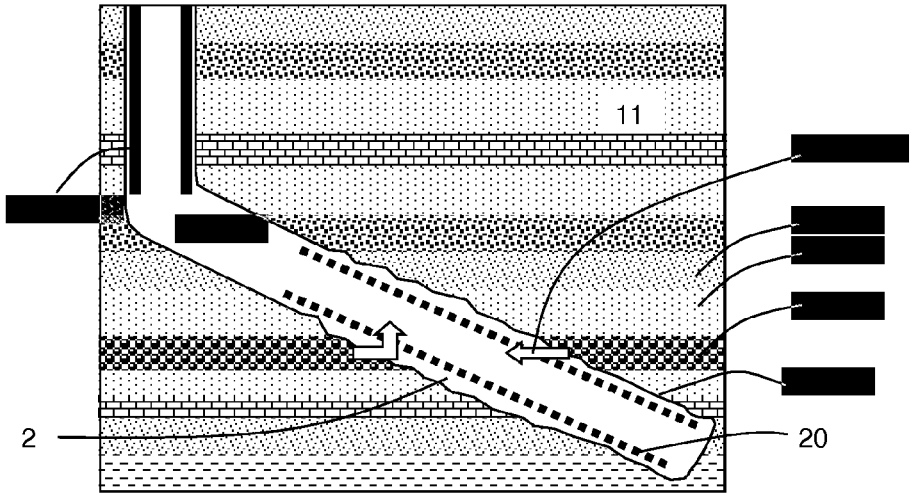
FIG. 1A to FIG. 1G show a schematic diagram illustrating the method according to the invention.

The present invention involves the use of an expanding sleeve that selectively isolates a portion of a permeable tube such as a perforated casing, or a slotted liner or an expandable and permeable screen, this isolation allowing the further treatment of the annulus zone between the permeable tube and the borehole. The typical applications for which the apparatus and method of the invention can be used include sand control and support of wellbore producing formations, in water, oil and/or gas wells. The apparatus and method of the invention can be used also in all type of geometry of wellbores, as highly deviated and horizontal wellbores.

FIGS. 1A to 1G are an illustration of the various steps of the method according to the invention. The method is intended for application in a well 1. The well is made of a wellbore 10 which is in communication with an earth formation 11, the earth formation comprising various strata of materials (110, 111 and 112). A casing 12 surrounded by an annular space filled with cement isolates the various producing zones from each other or from the well itself in order to stabilize the well or prevent fluid communication between the zones or shut off unwanted fluid production such as water. The inside of the well 1 is filled with a fluid 700 which is for example mud or drilling mud. The well further contains a permeable tube or screen 20 such as a perforated tubular, a tubular with other openings, a slotted liner or a screen (standalone, expandable or prepacked) located into the well and forming an annulus 2 between said tube 20 and the wellbore 10. The tube 20 is at least permeable to one material—permeable, meaning allowing the flowing of said one material through said tube—. Further, the tube 20 can be impermeable or can play the rule of a barrier to another material—impermeable, meaning not allowing the flowing of said another material through said tube—. The tube 20 can also be for example a type of sieve, where the tube allows the crossing of a material or morphology of material, as water or fine sand; and blocks the crossing of another material or another morphology of material, as stone or medium sand. The method according to the invention can be deployed when the tube 20 is at the bottom of the well or anywhere in the well, or when the tube 20 is further associated downhole and/or uphole with a casing. When referring to uphole, it is meant going towards the surface and downhole, it is meant going away from the surface.

The method of the invention is a method of treatment of a zone of the well which can be called a non-invasive method. Zone is defined as a part of the well or a region of the well which is delimited, but which can be quite small—from one cubic meter to ten cubic meters—and which can also be quite large—from hundred cubic meters to ten thousand cubic meters—. FIG. 1A shows, for example the flow 3 of water from stratum 112 into the well 1 through the annulus 2 and the tube 20. One example of realization can be to use the method of the invention to shut off said flow of water without changing the structure of the tube 20. Further, the isolation in the annulus is essential to prevent the flow of water.

Figure 1B:
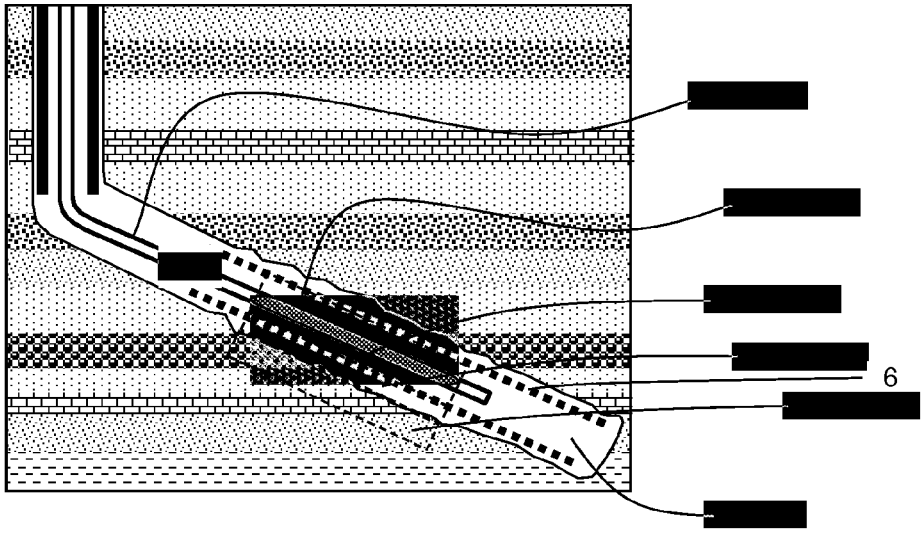
Figure 2A:
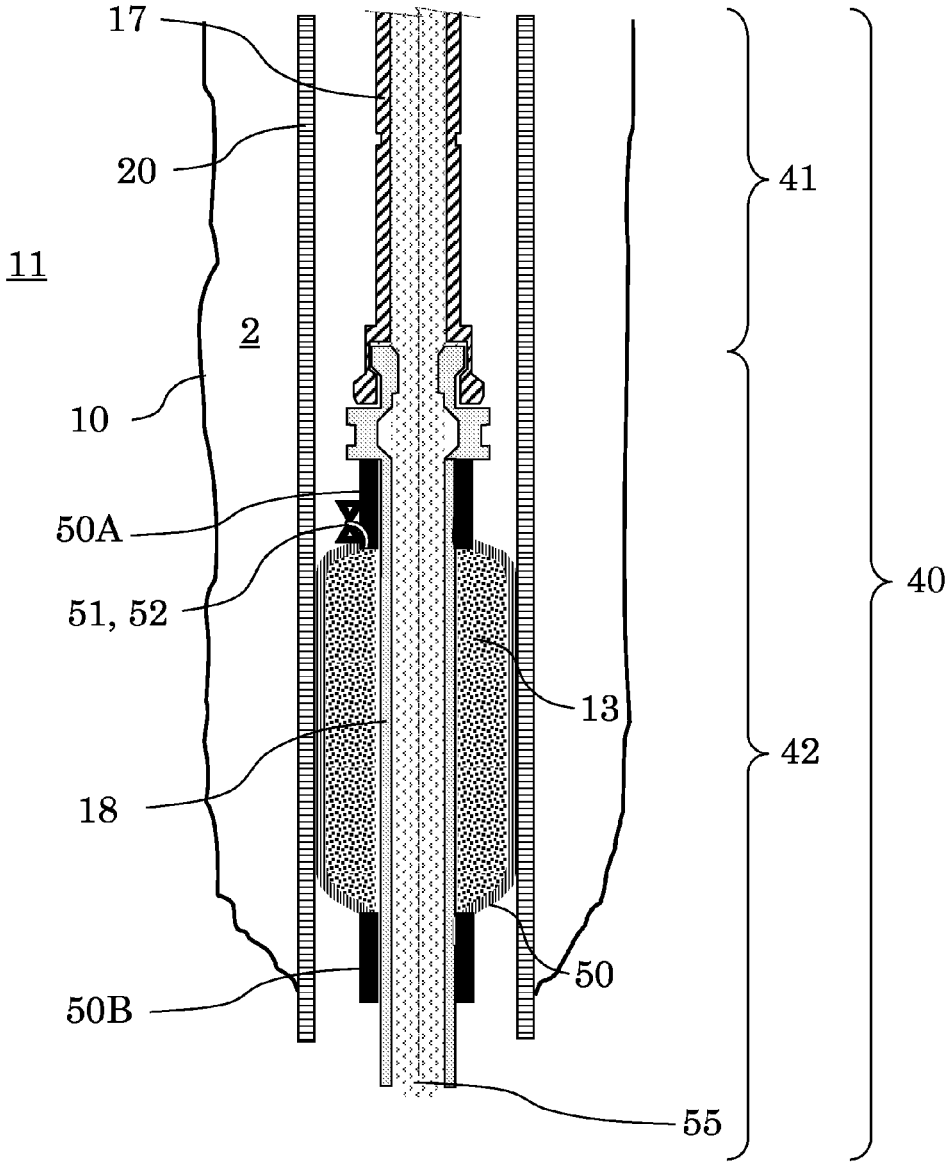
FIG. 2A shows a first embodiment of the apparatus according to the invention.

FIG. 1B shows the deployment of the apparatus 40 according to the invention. FIG. 2A shows in more details the apparatus 40. The apparatus 40 is lowered in the well from the surface, it comprises an upper section 41 made of a delivery pipe 17 and a lower section 42 made of a setting section 18. Advantageously, the setting section and the delivery pipe can be made of the same element: a setting pipe 19. The setting section is surrounded by an expandable sleeve or bladder 50. The sleeve 50 is at least impermeable to the said one material that the tube 20 is permeable—impermeable, meaning not allowing the flowing of said one material through said sleeve—. Further, the sleeve 50 can be permeable to another material—permeable, meaning allowing the flowing of said another material through said sleeve—. Preferably, the sleeve 50 is cylindrical and connected to the setting section 18 by one connecting means 50A at the upper level and with a second connecting means 50B at the lower level. The connecting means ensure tightness of the system {sleeve and setting section}. The connecting means 50A and 50B are distant from some meters to several meters; preferably the connecting means 50A and 50B are distant from a length D varying from 1 meter to 200 meters; more preferably between 1 meter and 50 meters. So the lower section 42 of the apparatus will practically have the same length D. As it can be understood when the lower section of the apparatus 40 has a length D of some meters (for example up to 10 meters), the lower section can be mounted on the surface, and the apparatus 40 can be lowered and run in the well and finally, deployed when required near the zone to treat. However, when the lower section of the apparatus 40 has a length D of several meters (below 10 meters or 100 meters for example), it is becoming hard to mount the setting section directly with the sleeve fully deployed on the surface. In a first aspect of the invention, the lower section of the apparatus 40 has a setting section already surrounded and mounted with a sleeve, the assembly being done at the surface or directly at the factory, the apparatus being lowered as such in the well. In a second aspect of the invention, the lower section of the apparatus 40 has a setting section surrounded with a sleeve, but not fixedly pre-mounted. The sleeve is arranged as a fan and can be deployed gradually on the setting section at the surface when lowered into the well or in the well when deploying near the tube. This second aspect of the invention will be explained below in more details.

Figure 1C:
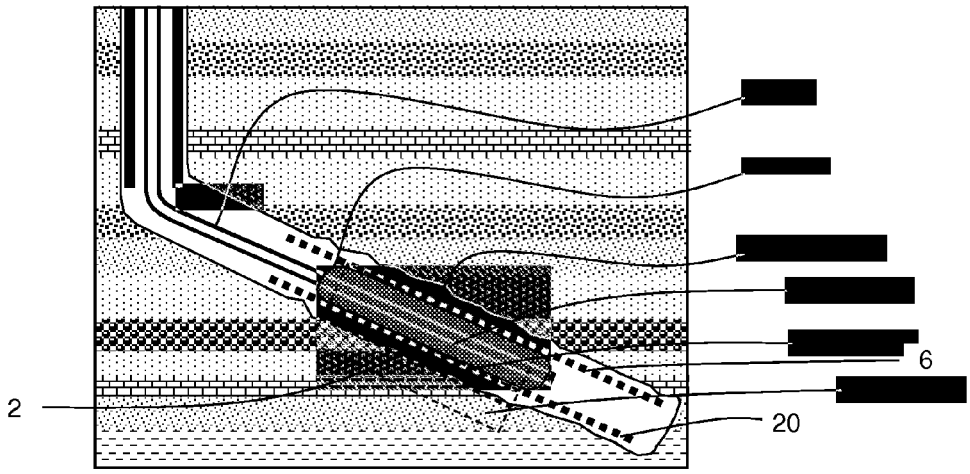

FIG. 1C shows the further step of deployment of the apparatus 40 according to the invention. The sleeve 50 is positioned inside the tube 20 in a zone 60. The zone 60 delimits the location where the sleeve 50 has to be positioned to ensure an efficient method of treatment. The zone 60 is defined by a cylinder inside the well, wherein the external surface of the cylinder is delimited by the tube 20. The zone of treatment can be delimited by a near zone 60B and a far zone 60C. The near zone 60B is defined by an annulus surrounding the zone 60, delimited by the tube 20 and the wellbore 10. The far zone 60C is defined by an annulus also surrounding the zone 60B, delimited at one side by the wellbore 10 and stretching into the earth formation from a fixed length L, varying from few centimeters to few meters, preferably the length L is between 2 centimeters to 15 meters and more preferably between 10 centimeters to 5 meters. The sleeve 50 is inflated thanks to an inflating means 51 located on the connecting means 50A. The inflating means 51 can also advantageously be located on another portion of the tool communicating with the inside of the system {sleeve and setting section}. The sleeve 50 is inflated with a component 13, which can be mud, water, Nitrogen or any type of gas or liquid. In one embodiment, the inflating means 51 is a check valve or any type of valve allowing circulating mud from the inside of the well into the inside of the sleeve 50 but not the reverse. In a second embodiment, the inflating means 51 is a pump in communication with the inside of the well delivering mud as component 13. In a third embodiment, the inflating means 51 is a reservoir delivering gas as component 13, said gas can be Nitrogen, carbon dioxide or air. The inflating means 51 can be self activated or activated remotely from surface or activated by a timer or by another device located in the well. When inflated, a part of the sleeve is in contact with a zone of the tube 20, said contact zone or interface is called zone 60A. The zone 60A should be comprised in the surface defined by the intersection of zone 60 and zone 60B. The sleeve 50 is inflated enough to ensure a tight contact. Said tight contact ensures that the zone 60A made of the interface sleeve/tube becomes impermeable to the said one material that the tube 20 is permeable. A zone 6 is left permeable to the said one material, so the material can flow from the inside of the well to the annulus 2 and to the zone 60B through the zone 6. The zone 60A can cover the entire tube 20 and the zone 6 can be a zone, located downhole compared to apparatus 40 or below the setting section 18 and the sleeve 50, void of casing or tube directly in communication with the annulus and with the zone 60B. Also the zone 60A can cover a part of the tube 20 and the zone 6 can be another part of the tube 20 still permeable, said another part located downhole compared to apparatus 40 or below the setting section 18 and the sleeve 50. The sleeve 50 follows the shape of the setting section when deflated and has a shape practically cylindrical when inflated.

Figure 1D:
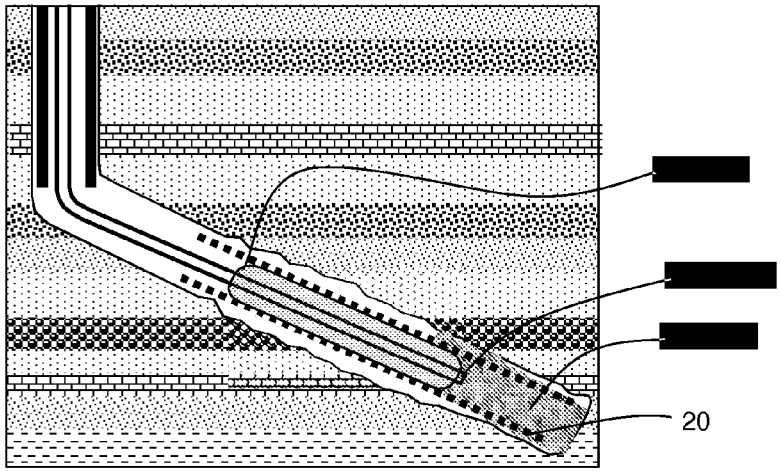
Figure 1E:
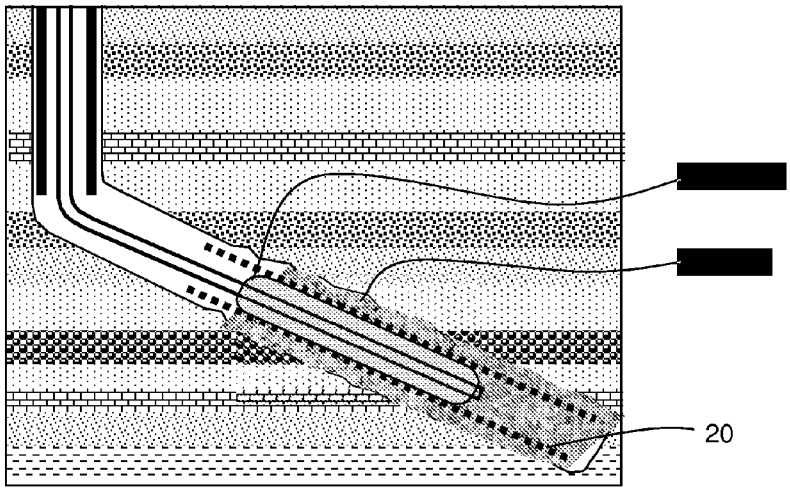

FIG. 1D shows the pumping of a treatment fluid 70 into the well. The treatment fluid is a component that flows through the tube 20—the tube 20 is permeable to this treatment fluid 70—. The treatment fluid flows into the well through delivering means or delivery opening 55 positioned at the lower end of the setting section 18 below the sleeve 50. Once arrived below the setting section 18, the treatment fluid 70 tends to returns to the surface. Ideally the treatment fluid 70 should have the same density as the fluid 700 already in the well. As the sleeve 50 plugs the inside of the tube 20, the treatment fluid 70 is forced to circulate through the tube 20 or at least through the part 6 of the tube 20, and the treatment fluid 70 will flow all along the annulus 2 between the zone 60A and the wellbore. If the treatment fluid has not the same density as the fluid 700 already in the well, there is a risk that by gravity the treatment fluid 70 will first fill part of the well below the setting section 18 and the sleeve 50 (said zone below zone 60 is called zone 70A—FIG. 1G—) despite the fact that said zone 70A is closed volume already filled with the fluid 700. For example, to limit this risk, as it will be explained below in more details, few barrels of a viscous fluid can first be pumped into said zone 70A or at least into a part of said zone 70A.

Aim of the impermeabilisation of the zone 60A allows the treatment fluid 70 to rise into the zone 60B (FIG. 1E) instead of rising into the inside of the well via zone 60. Once the entire zone 60B to be treated is filled with the treatment fluid, the pumping of the treatment fluid is stopped. Advantageously, depending on the composition of the treatment fluid 70 and on the composition of the earth formation beyond the wellbore (in the zone 60C), the treatment fluid can, after having filled the zone 60B, flow into the zone 60C. The pumping of the treatment fluid can be re-launched if needed to compensate for the fluid treatment flowing into the zone 60C and re-stopped when required. This step can be further re-executed a number of times, as needed. All along this time, the sleeve 50 is left inflated, ensuring impermeability of zone 60A, the time needed that the treatment fluid 70 makes its action in zone 60B and/or in zone 60C. As a first example of realization, the treatment fluid can be an acid for acid fracturing of the zone 60C or a chemical activator for activating zone 60C. As a second example of realization, the treatment fluid can be a settable fluid to set in zone 60B and/or in zone 60C, the settable fluid can be a permeable cement, a remedial cement or any type of cement or other sealant e.g. epoxy or furan resin.

Figure 1F:
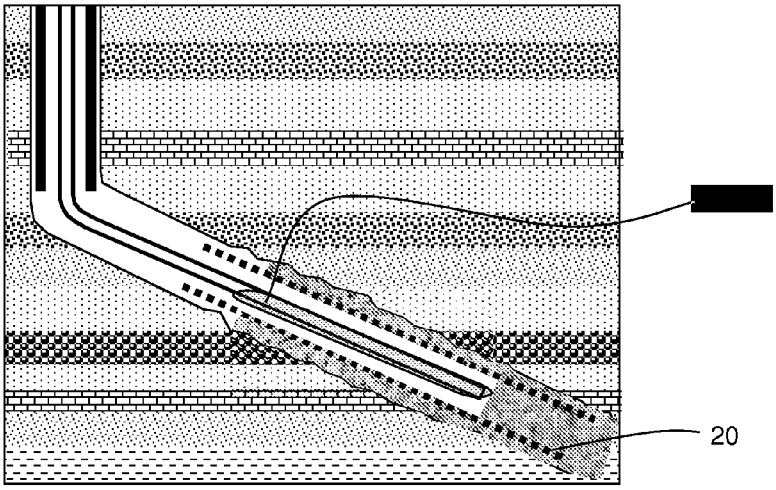
Figure 1G:
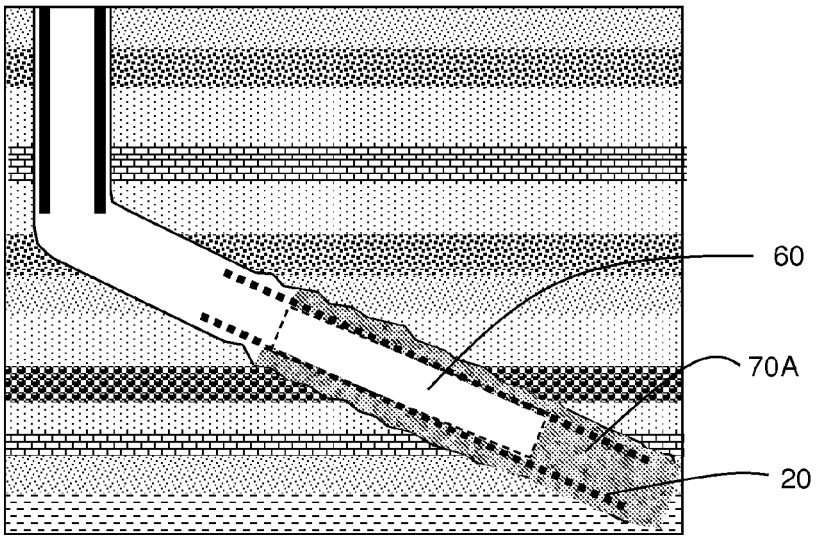

After the zone 60B and/or the zone 60C is treated, the sleeve 50 is deflated (FIG. 1F). The sleeve 50 is deflated thanks to a deflating means 52 located on the connecting means 50A. The deflating means 52 can also advantageously be located on another portion of the tool communicating with the inside of the system {sleeve and setting section}. Preferably, the deflating means 52 and the inflating means 51 are the same means allowing choice between inflation or deflation of the sleeve. For the first example of realization, when the treatment fluid is a non-settable fluid, but an acid or activator, the deflated sleeve allows the treatment fluid to flow back into the well. Advantage of the use of the sleeve, is that the treatment of the zone 60B and/or the zone 60C can be done with a lesser quantity of treatment fluid than will be needed without sleeve—without sleeve, the entire zone 60 would have needed to be filled with the treatment fluid—. For the second example of realization, when the treatment fluid is a settable fluid, the deflated sleeve leaves the zone 60B and/or zone 60C with the set fluid. Advantage of the use of the sleeve, is that the inside of the tube 20 is left void of any type of pollution, as set fluid—without sleeve, the entire zone 60 would have been filled with the set fluid, requiring a further step of drilling the entire zone 60—. FIG. 1G shows the same well as in FIG. 1A after treatment with the method and apparatus according to the invention with a settable fluid. The apparatus 40 with the sleeve 50 has been removed from the well. The zone 60B and/or the zone 60C have been treated and the entire zone 60 remains unaffected by the treatment.

In a first embodiment, the method and the apparatus according to the invention are deployed at the bottomhole of the well, all the volume of the zone 70A left downhole of the apparatus 40 can be filled with the treatment fluid. After the treatment is finished, the set fluid set remaining in zone 70A can be drilled with a drilling tool lowered into the well from surface.

In a second embodiment, the method and the apparatus according to the invention are deployed anywhere in the well, the volume of the zone 70A left downhole of the apparatus 40 is unknown and considered big. If the treatment fluid 70 has the same density as the fluid 700 already in the well, there is no risk that the treatment fluid fill first the zone 70A. However, if the treatment fluid 70 has not the same density as the fluid 700 already in the well two solutions can be used. One solution can be to pump few barrels of a viscous fluid into a part of said zone 70A, for example viscous fluid can be viscous bentonite pill, a delayed-gel, a reactive fluids system (RFS). If this is not sufficient, a second solution can be to mechanically isolate a part of said zone 70A with a second apparatus. Said second apparatus will be deployed first and will act as a plug so to limit the zone 70A to a smallest volume.

An example of such a second apparatus can be found in U.S. Pat. Nos. 3,460,625; 2,922,478 and preferably in the co-pending European patent application from the Applicants under application number 05291785.3. Preferably, said second apparatus is deployed with the apparatus 40 and is positioned downhole compared to the apparatus 40; the second apparatus acts as a plug and the apparatus 40 can be used as described from FIG. 1D to 1G. The plug can be reusable or releasable. As a first example of embodiment, when the treatment fluid is a non-settable fluid, the second apparatus can be connected to the apparatus 40 and can have a reusable plug which is deployed the time the sleeve 50 is inflated. When the sleeve 50 is deflated, the plug is removed also—the plug can also be an expandable sleeve for example—. So, the treatment fluid falls into the well when the apparatus 40 and the second apparatus are removed from the well, leaving the zone 60B and/or the zone 60C treated and the inside of the tube near zone 60 void of any pollution. As a second example of embodiment, when the treatment fluid is a settable fluid, the second apparatus can be connected to the apparatus 40 and can have a releasable plug which is deployed the time the sleeve 50 is inflated. When the sleeve 50 is deflated, the apparatus 40 and the second apparatus are removed, the plug is released. Either the volume of the set fluid in zone 70A is sufficient to push the plug downhole and the plug falls lower into the well or zone 70A with the plug can be drilled with a drilling tool lowered into the well from surface.

In a further step, another zone of the well can be treated with the method according to the invention by deploying the apparatus in said another zone, if for example there are multiple and separated zones in the well or if the zone to be treated is too long to be treated with a single treatment.

FIG. 2A shows a view in details of the apparatus according to the invention in a first embodiment. The apparatus 40 is lowered in the well from the surface, it comprises an upper section 41 made of a delivery pipe 17 and a lower section 42 made of a setting section 18. The delivery pipe 17 can be a drill pipe or coiled tubing. The setting section 18 can be a drill pipe or coiled tubing, it can be also a tube made of metal or a rigid and resistant material as composite. The setting section 18 is surrounded by an expandable sleeve or bladder 50. The expandable sleeve 50 can be formed from an elastic but resistant material, for example rubber. The expandable sleeve is connected to the setting section 18 by one connecting means 50A at the upper level and with a second connecting means 50B at the lower level. The connecting means 50A and 50B are systems of fixation of the expandable sleeve 50 to the setting section 18 as screwing, hanging, sticking, crimping, hooping. The sleeve 50 is inflated thanks to a check valve 51-52 located on the connecting means 50A. The sleeve 50 is inflated with mud 13 present inside the well. The sleeve is deflated thanks also to the check valve 51-52 which is unlocked and allows exit of mud. The apparatus 40 comprises a hole 55 at the lower level of the lower section 42 to ensure delivering of the fluid treatment inside the well.

Figure 2B:
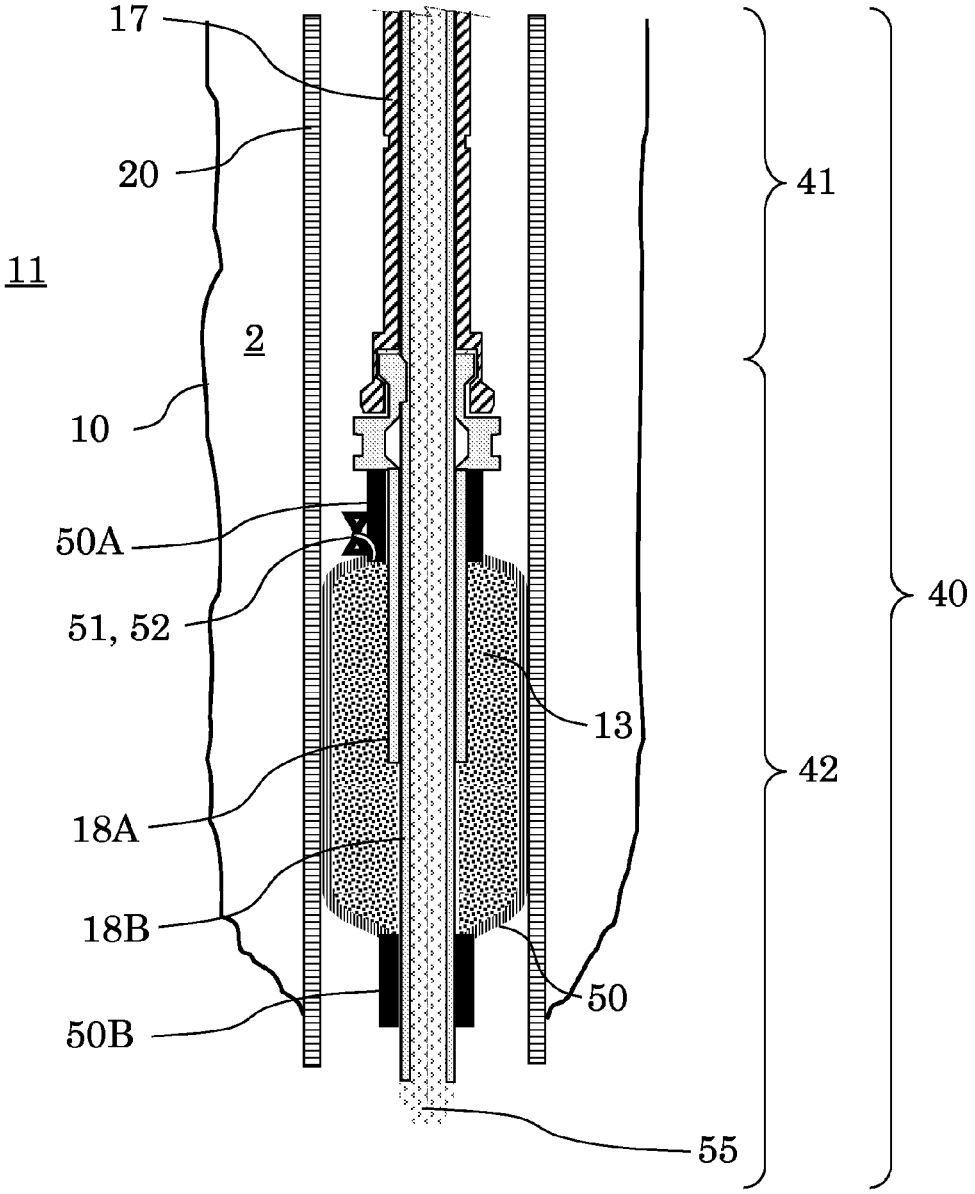
FIG. 2B shows a second embodiment of the apparatus according to the invention.

FIG. 2B shows a view in details of the apparatus according to the invention in a second embodiment. The apparatus 40 is lowered in the well from the surface, it comprises an upper section 41 made of a delivery pipe 17 and a lower section 42 made of at least two setting sections 18A and 18B mounted telescopically. Preferably, the setting sections 18B is connected to the surface and slides on the setting section 18A inside said last one. The delivery pipe 17 can be a drill pipe or coiled tubing. The setting sections 18A and 18B can be a drill pipe or coiled tubing, it can be also a tube made of metal or a rigid and resistant material as composite. The setting sections 18A and 18B are surrounded by an expandable sleeve or bladder 50 arranged as a fan. The expandable sleeve is connected to the setting section 18A by one connecting means 50A at the upper level and is connected to the setting section 18B by a second connecting means 50B at the lower level. The connecting means 50A and 50B are systems of fixation of the expandable sleeve 50 to the setting section 18 as screwing, hanging, sticking, crimping, hooping. When the setting section 18B slides on the setting section 18A, the setting section 18B deployed the sleeve 50 on the setting sections 18A and 18B. From a closed position where length of the sleeve is of some meters—sleeve being arranged as a fan on the setting sections 18A and 18B—, the sleeve can go to a deployed position with a length of several meters (up to 200 meters or 100 meters)—sleeve being deployed with the setting section 18B—. The expandable sleeve 50 can be formed from an elastic but resistant material, for example rubber. The sleeve 50 is inflated thanks to a check valve 51-52 located on the connecting means 50A. The sleeve 50 is inflated with mud 13 present inside the well. The sleeve is deflated thanks also to the check valve 51-52 which is unlocked and allows exit of mud. The apparatus 40 comprises a hole 55 at the lower level of the lower section 42 to ensure delivering of the fluid treatment inside the well.

Figure 3A:
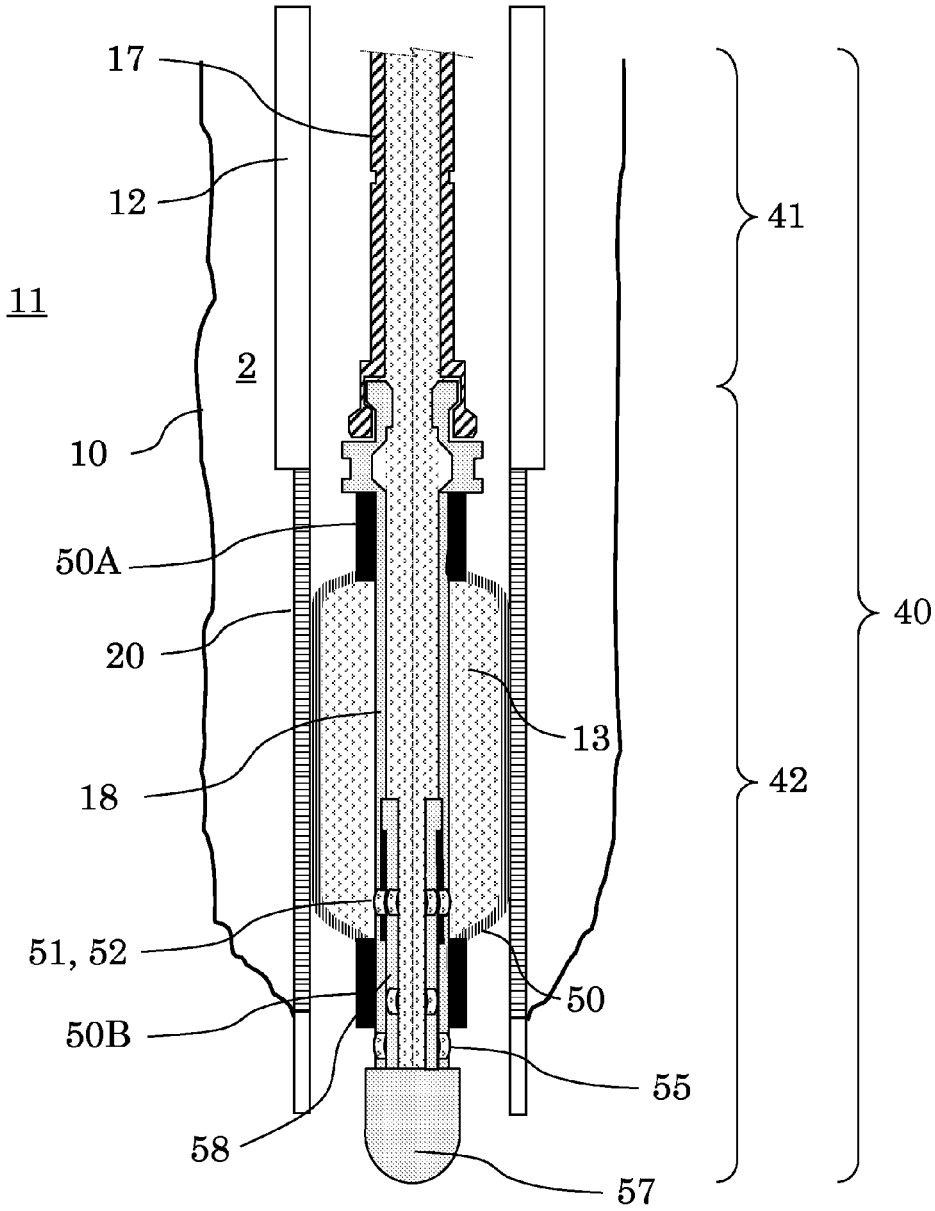
FIGS. 3A to 3C show a third embodiment of the apparatus according to the invention.
Figure 3B:
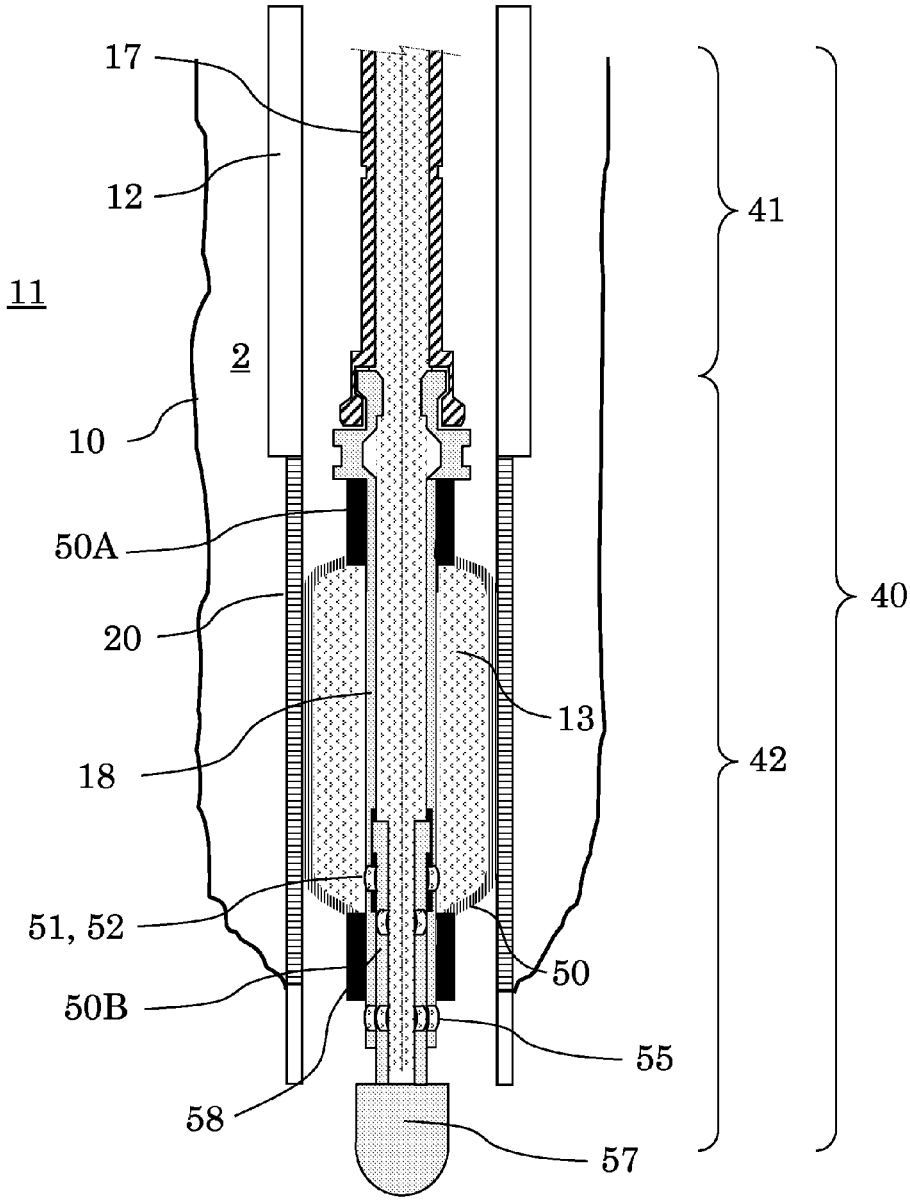
Figure 3C:
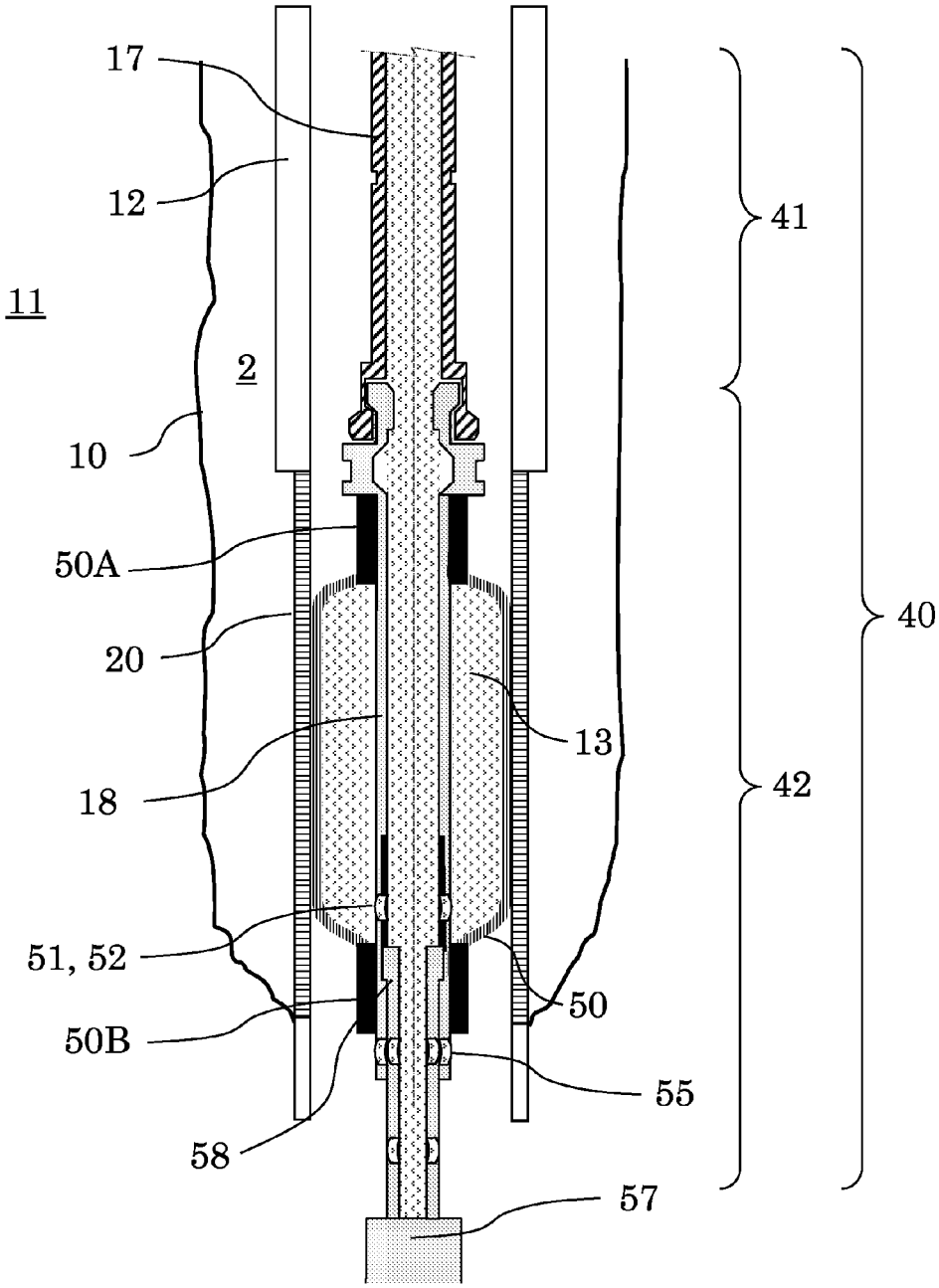

FIGS. 3A to 3C show a view in details of the apparatus according to the invention in a third embodiment. The apparatus 40 is lowered in the well from the surface, it comprises an upper section 41 made of a delivery pipe 17 and a lower section 42 made of a setting section 18. The delivery pipe 17 can be a drill pipe or coiled tubing. The setting section 18 can be a drill pipe or coiled tubing, it can be also a tube made of metal or a rigid and resistant material such as a composite material. The setting section 18 is surrounded by an expandable sleeve or bladder 50. The expandable sleeve 50 can be formed from an elastic but resistant material, for example rubber. The expandable sleeve is connected to the setting section 18 by one connecting means 50A at the upper level and with a second connecting means 50B at the lower level. The connecting means 50A and 50B are systems of fixation of the expandable sleeve 50 to the setting section 18 as screwing, hanging, sticking, crimping, hooping. The setting section 18 comprises openings 51-52 for inflated/deflated the sleeve. The setting section 18 comprises openings 55 for delivering treatment fluid inside the well. An additional tube 58 is mounted inside the setting section 18 and is weighted on the lower part of the additional tube 58 with optionally a weighting element 57. Further, the delivering openings 55 can have a deflector (not shown on Figures) forcing the delivery uphole and/or on the tube. The additional tube 58 comprises also openings for inflated/deflated the sleeve and for delivering treatment fluid inside the well, but not juxtaposed with the last of the setting section 18. So, the system 57 and 58 slides in the setting section and allows the choice between: inflation of the sleeve, delivering of the treatment fluid, or deflation of the sleeve. In a first position (FIG. 3A), the sleeve is inflated with the treatment fluid or with any type of fluid 13. When the sleeve is correctly inflated, the pressure inside the setting section reaches a certain threshold and breaks the fingers or unlocks shear screws retaining the additional tube 58 in first position. The additional tube slides thanks to the weighting element or the load resulting from the pressure inside the tube to a second position (FIG. 3B). In the second position, the sleeve is blocked inflated, and the treatment fluid can be delivered inside the well, into the zone to treat. Finally, when all the volume that can be filled is full, the pressure inside the setting section reaches another certain threshold and unlocks the fingers or breaks shear screws retaining the additional tube 58 in second position. The additional tube slides thanks to the weighting element or the load resulting from the pressure inside the tube to a third position (FIG. 3C). In the third position, the sleeve can be deflated, and the retained treatment fluid or any type of fluid is delivered inside the well. The apparatus 40 is removed from the well and can be reutilized by rearming it. When shear screws are used to lock or unlock from first to third position, all the system 57 and 58 is pushed back into the setting section and another job can be completed with the same apparatus. It can also not be useful to remove the apparatus from the well to rearm it. Effectively, by pushing it to the bottomhole of the well, the apparatus can be rearmed by pressing it to the bottom.

Figure 4A:
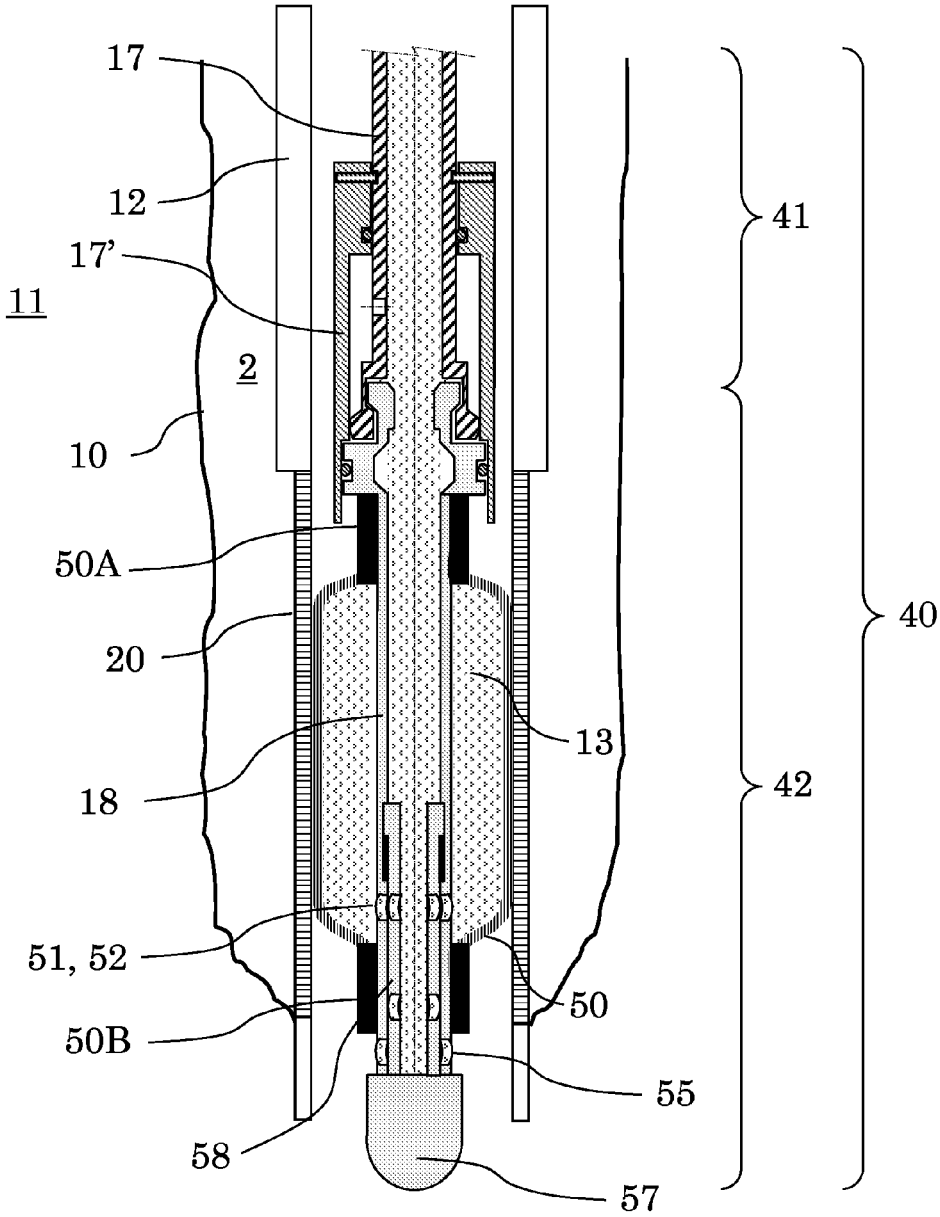
FIGS. 4A to 4C show a fourth embodiment of the apparatus according to the invention.
Figure 4B:
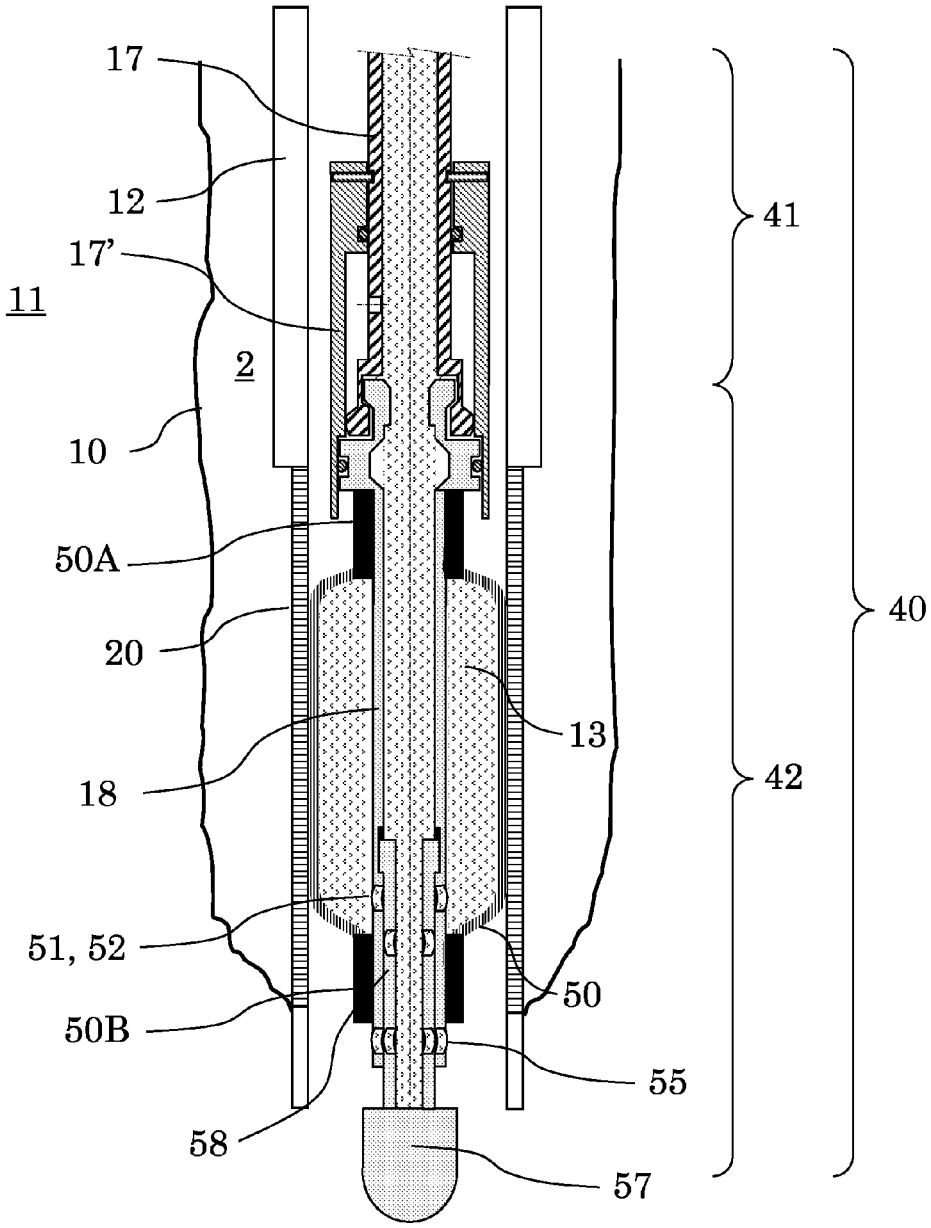
Figure 4C:
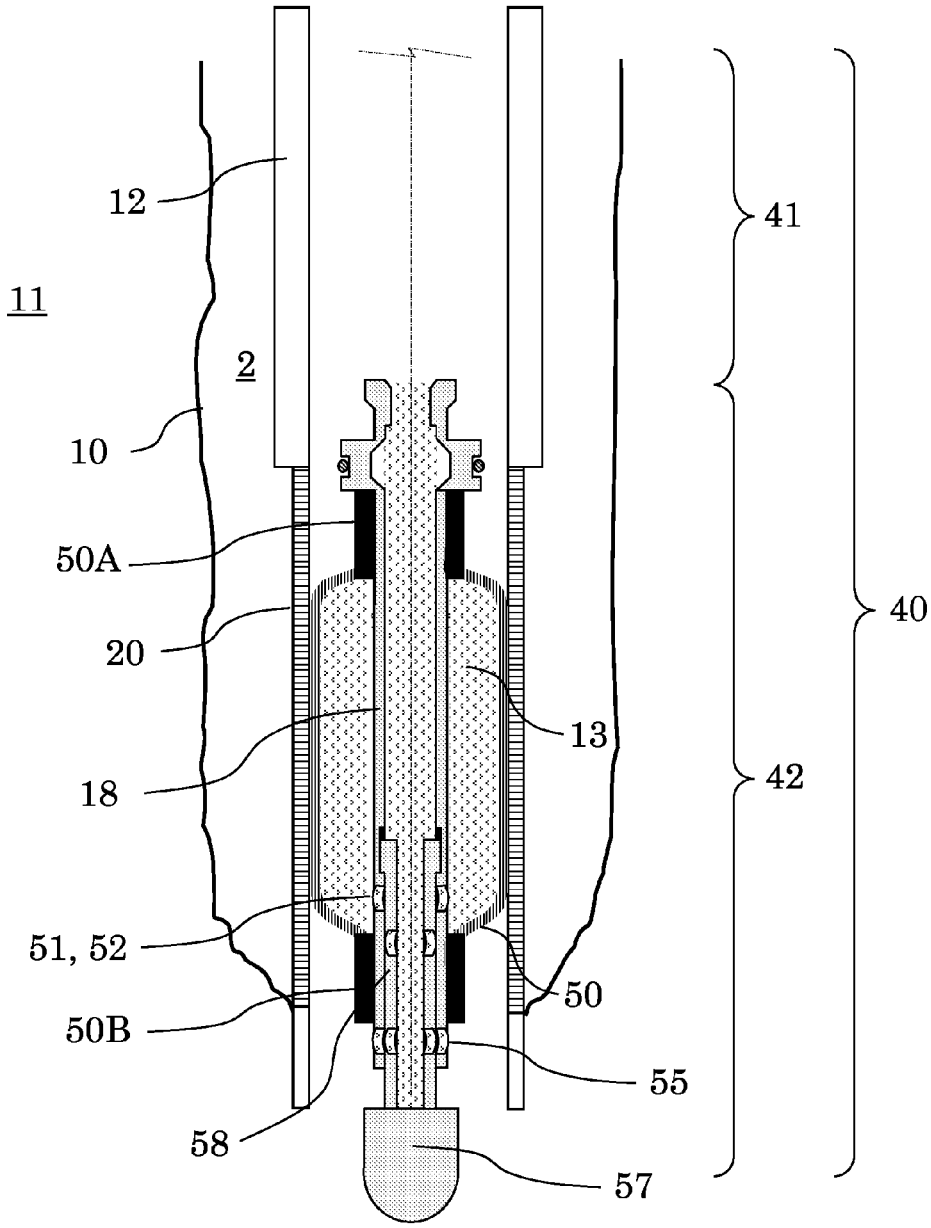

FIGS. 4A to 4C show a view in details of the apparatus according to the invention in a fourth embodiment. The apparatus 40 is lowered in the well from the surface, it comprises an upper section 41 made of a delivery pipe 17 and a lower section 42 made of a setting section 18. The delivery pipe 17 can be a drill pipe or a coiled tubing. The setting section 18 is made of a rigid but drillable stinger with a material such as light metal or alloy, e.g. aluminum or such as friable plastic or composite e.g. fiberglass, epoxy resin materials. The material, when drilled, has to transform rapidly and easily in small cuts. The setting section 18 is surrounded by an expandable sleeve or bladder 50. The expandable sleeve 50 can be formed from an elastic but resistant material, for example as rubber. The expandable sleeve is connected to the setting section 18 by one connecting means 50A at the upper level and with a second connecting means 50B at the lower level. The connecting means 50A and 50B are systems of fixation of the expandable sleeve 50 to the setting section 18 as case, screwing, hanging, sticking. The delivery pipe 17 comprises also a disconnect mechanism 17', allowing the delivery pipe to abandon the lower section 42 of the apparatus 40 when required or at the end of the treatment.

Figure 5A:
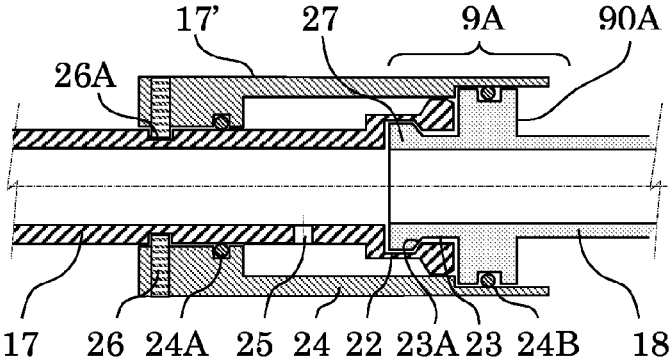
FIG. 5A shows a detailed part of the fourth embodiment of the apparatus according to the invention.

FIG. 5A is a view in details of the upper level of the setting section showing the disconnect mechanism 17'. The setting section 18 comprises at the upper level 9A a connector 27 allowing a disconnection of the setting section 18 from the delivery pipe 17. The connector 27 is connected to the delivery pipe 17 by elastic fingers 22 or keys. The elastic fingers engage into a groove 23 cut into the setting section 18. A ramp 23A allows disengagement of the elastic fingers 22 from the groove 23. The elastic fingers are made of an elastic metal or elastic plastic or composite material. A sliding sleeve 24 surrounding the delivery pipe 17 is further present and can displace along the delivery pipe to cover the system {elastic fingers, groove}. The sliding sleeve 24 is made of metal or plastic or composite material. Preferably, the sliding sleeve 24 is equipped with a brake pressing against the delivery pipe or a locking mechanism 26 to maintain the sliding sleeve 24 in position. For example, the locking mechanism 26 can be made of one or several shear screws engaged in a groove 26A cut in the delivery pipe 17. A first seal 24A is located on the sliding sleeve 24 and ensures tightness between sliding sleeve 24 and delivery pipe 17. A second seal 24B is located on the setting section 18 and ensures tightness between sliding sleeve 24 and setting section 18. The diameters of the seals 24A and 24B are different; the diameter of the seal 24B is larger than the diameter of the seal 24A.

The setting section 18 comprises openings 51-52 for inflated/deflated the sleeve. The setting section 18 comprises openings 55 for delivering treatment fluid inside the well. An additional tube 58 is mounted inside the setting section 18 and is weighted on the lower part of the additional tube 58 with optionally a weighting element 57. Further, the delivering openings 55 can have a deflector (not shown on Figures) forcing the delivery uphole and/or on the tube. The additional tube 58 comprises also openings for inflating/deflating the sleeve and for delivering treatment fluid inside the well, but not juxtaposed with the last of the setting section 18. So, the system 57 and 58 slides in the setting section and allows the choice between: inflation of the sleeve, delivering of the treatment fluid, or deflation of the sleeve. In a first position (FIG. 3A), the sleeve is inflated with the treatment fluid or with any type of fluid 13. When the sleeve is correctly inflated, the pressure inside the setting section reaches a certain threshold and breaks the fingers or unlocks shear screws retaining the additional tube 58 in first position. The additional tube slides thanks to the weighting element or the load resulting from the pressure inside the tube to a second position (FIG. 3B). In the second position, the sleeve is blocked inflated, and the treatment fluid can be delivered inside the well, into the zone to treat. Finally, when all the volume that can be filled is full, the pressure inside the setting section and the delivery pipe reaches another certain threshold and disconnects the disconnect mechanism 17' as it will be explained in further details. The delivery pipe 17 is removed from the well, and the lower section 42 of the apparatus 40 is left in the well. This lower section 42 of the apparatus can be drilled in a further step after.

Figure 5B:
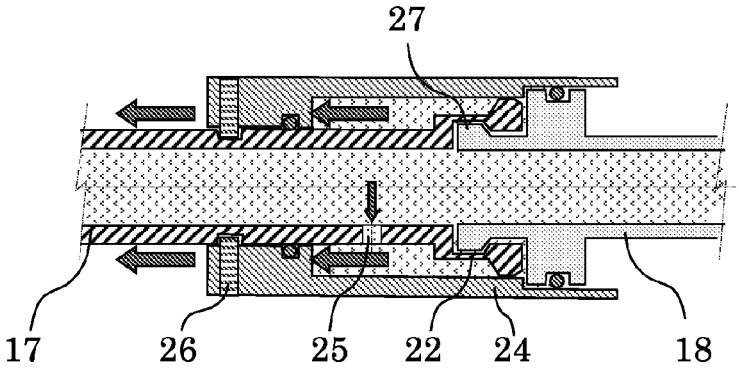
FIG. 5B shows the functioning principle of the disconnecting mechanism (connected position).
Figure 5C:
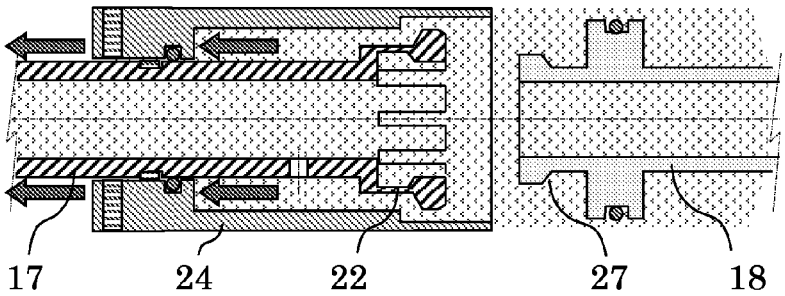
FIG. 5C shows the functioning principle of the disconnecting mechanism (disconnected position).

FIGS. 5B and 5C show the connector 27 in action of disconnection. FIG. 5B shows the connector locked to the delivery pipe 17. The elastic fingers 22 are engaged into the groove 23 and can not retract as long as the sliding sleeve 24 is covering them. An internal cavity is formed between the sliding sleeve and the delivery pipe 17 and tightness is maintained in the cavity thanks to both seals 24A and 24B. Through the orifice 25 the same pressure is applied inside the cavity than inside the bladder. Thus the sliding sleeve 24 is sensible to the same differential pressure as the bladder, but it is secured in its initial locked position by the locking mechanism 26. The diameters of the seals 24A and 24B are different so the internal pressure of the treatment fluid or any type of fluid 13 acting on the differential area (created by difference of diameters of the seals 24A and 24B) induces a load that tends to move the sliding sleeve 24 against the brake or locking mechanism 26. If the pressure increases above a given threshold, the induced axial load shears the locking mechanism and the sliding sleeve translates to the unlocked position (shown on FIG. 5C). As shown on FIG. 5A, the diameter of the seal 24B is larger than the diameter of the seal 24A, the sliding sleeve 24 translating on the delivery pipe 17 and remaining on it. Another symmetric configuration could be obtained where the diameter of the seal 24A is larger than the diameter of the seal 24B, the sliding sleeve 24 translating on the setting section 18 and remaining on it. The locking mechanism sets the threshold below the burst pressure of the expandable sleeve 50. When the sliding sleeve 24 moves, it frees the elastic fingers 22, and the ramp 23A pushes the elastic fingers 22 away, disconnecting the delivery pipe. In fact, the sliding sleeve 24 acts as a piston.

The invention claimed is:

1. A method of treatment of a near zone of a well, a far zone of a well or both a near zone and a far zone of a well, wherein the well penetrates a subterranean formation, and has a wellbore and a wellbore wall; wherein, inside the well, the wellbore is filled with a previously installed tube which is permeable to a material; wherein, the tube forms an annulus with the wellbore wall, the annulus being the near zone; wherein, a region inside the formation that is concentric to the near zone is the far zone; wherein, the zones are adjacent to the tube in the annulus, the method comprising:

(i) placing inside the tube a setting section surrounded by a sleeve adjacent to the near and far zones to treat, the sleeve being expandable and impermeable to the material, wherein the sleeve is first placed inside the tube and the setting section is then placed inside the sleeve;

(ii) inflating the sleeve so that the sleeve is in contact with the tube near the near and far zones to treat, ensuring that a first zone of the tube is impermeable to the material, but leaving a second zone permeable to the material;

(iii) pumping a treatment fluid to the near and far zones to treat, the treatment fluid passing into the annulus via the second zone still permeable to the material;

(iv) treating the near zone to treat, the far zone to treat or both the near and far zone to treat with the treatment fluid;

(v) deflating the sleeve so that the sleeve is no longer in contact with the tube near the near and far zones to treat; and (vi) removing the setting section with the sleeve from the near and far zones to treat by pulling it out.

2. The method of claim 1, wherein the second zone is a void making communication with the near zone to treat.

3. The method of claim 1, wherein the second zone is an element permeable to the material.

4. The method of claim 3, wherein the second zone is a part of the tube.

5. The method of claim 1, further comprising removing the setting section surrounded by the sleeve.

6. The method according to claim 1, wherein the step (i) of placing a setting section surrounded by a sleeve is performed by first placing the sleeve inside the tube and then placing the setting section inside the sleeve.

7. The method according to claim 1, wherein the step (i) of placing a setting section surrounded by a sleeve is performed by placing into the tube the setting section already surrounded by the sleeve.

8. The method according to claim 1, wherein the well has a longitudinal axis (A) and wherein the step (i) of placing a setting section surrounded by a sleeve further comprises the step of deploying the sleeve longitudinally to the axis (A).

9. The method according to claim 1, wherein the setting section has an upper part and a lower part, the setting section being connected to a delivery section going to surface that is connected to the upper part, and being in communication with the inside of the well at the lower part through a delivery opening, and wherein the step (iii) of pumping a treatment fluid to the zones to treat is performed by:

delivering the treatment fluid inside of the well through the delivery section, through the setting section and through the delivery opening;

filling the inside of the well located downhole from the lower part with the treatment fluid, until the treatment fluid passes into the annulus via the second zone still permeable to the material; and rising the treatment fluid into the near zone to treat, the far zone to treat of both the near and far zones to treat.

10. The method according to claim 1, wherein the setting section is a member selected from the list consisting of coiled tubing and drill pipe.

11. The method according claim 9, wherein the delivery section is a member selected from the list consisting of coiled tubing and drill pipe.

12. The method according to claim 1, wherein the setting section has an upper part and a lower part, the setting section being connected to a delivery section going on surface at the upper part, and being in communication with the inside of the well at the lower part through a delivery opening, and wherein the step (iii) of pumping a treatment fluid to the near and far zones to treat is performed by:

delivering a first fluid inside of the well through the delivery section, through the setting section and through the delivery opening;

filling the inside of the well located downhole from the lower part with the first fluid, until the first fluid becomes a plug inside of the well;

delivering the treatment fluid inside of the well through the delivery section, through the setting section and through the delivery opening;

filling the inside of the well located downhole from the lower part and uphole from the plug, with the treatment fluid, until the treatment fluid passes into the annulus via the second zone still permeable to the material; and rising the treatment fluid into the near zone to treat, the far zone to treat or both the near and far zones to treat.

13. The method of claim 12, wherein the first fluid is a member selected from the list consisting of viscous bentonite fluid, a delayed-gel fluid and a reactive fluids system.

14. The method according to claim 1, wherein the setting section has an upper part and a lower part, the setting section being connected to a delivery section going on surface at the upper part, and being in communication with the inside of the well at the lower part through a delivery opening, and wherein the step (iii) of pumping a treatment fluid to the near and far zones to treat is performed by:

deploying a plug inside of the well;

plugging the inside of the well located downhole from the lower part with the plug;

delivering the treatment fluid inside of the well through the delivery section, through the setting section and through the delivery opening;

filling the inside of the well located downhole from the lower part and uphole from the plug, with the treatment fluid, until the treatment fluid passes into the annulus via the second zone still permeable to the material; and rising the treatment fluid into the near zone to treat, the far zone to treat or both the near and far zones to treat.

15. The method of claim 14, wherein the plug is a device with an expandable sleeve which acts as a plug when the expandable sleeve is inflated.

16. The method according to claim 1, wherein the tube is a member selected from the list consisting of perforated casing, perforated tubing, perforated pipe, perforated conduit, slotted liner, screen, expandable casing, expandable screen, tube comprising an opening, tube comprising a permeable component, and a permeable component.

17. The method according to claim 1, wherein the treatment fluid is a settable fluid and further comprising allowing the treatment fluid to set.

18. The method of claim 17, wherein the settable fluid is a member selected from the list consisting of: conventional cement, remedial cement, permeable cement, phosphate cement, special cement, inorganic and organic sealants, remedial resin, permeable resin and geopolymer materials.

19. The method of claim 18, further comprising drilling the well with a drilling tool.

20. The method of claim 19, wherein the settable fluid is a member of the list consisting of: conventional cement, remedial cement, permeable cement, phosphate cement, special cement, inorganic and organic sealants, remedial resin, permeable resin and geopolymer materials.

* * * * *